US005853124A

United States Patent [19]

Beck et al.

[11] Patent Number: 5,853,124

[45] Date of Patent: Dec. 29, 1998

[54] BOTTOM SEATED PINTLE NOZZLE

[75] Inventors: Niels John Beck, Bonita; William P. Johnson, Valley Center; Kresimir Gebert, San Diego; Hoi Ching Wong, Carlsbad, all of Calif.

[73] Assignee: Servojet Products International, San Diego, Calif.

[21] Appl. No.: 851,476

[22] Filed: May 5, 1997

[51] Int. Cl.[6] ..... F02M 3/08

[52] U.S. Cl. ..... 239/5; 239/533.9

[58] Field of Search ..... 239/452, 453, 239/456, 459, 533.2–533.12, 5

[56] References Cited

U.S. PATENT DOCUMENTS

| | | | |
|---|---|---|---|
| 1,690,893 | 11/1928 | Dorner | 239/453 |
| 2,017,028 | 10/1935 | Heinrich et al. | 239/453 |
| 3,830,433 | 8/1974 | Miyake et al. | 239/533 |
| 4,524,914 | 6/1985 | Kaibara et al. | 239/452 |
| 5,211,340 | 5/1993 | Yoshizu | 239/533.9 X |
| 5,392,745 | 2/1995 | Beck | 123/295 |

FOREIGN PATENT DOCUMENTS

| | | | |
|---|---|---|---|
| 950252 | 2/1961 | United Kingdom | 239/453 |

OTHER PUBLICATIONS

"A Study on a New Combustion System for D.I. Diesel Conical Spray Combustion System"; Z. Yuanxian et al., Chinese Society for the I.C. Engine Paper No. 871025, pp. 1–16.

"Effects of Fuel Injection on Diesel Combustion"; Beck et al., Paper No. 880299, BKM, Inc, pp. 1–28.

"Injection Rate Shaping and High Speed Combustion Analysis–New Tools for Diesel Engine Combustion Development"; Beck et al., SAE International, Paper No. 900639, pp. 1–18.

"Factors that Affect BSFC and Emissions for Diesel Engines: Part II Experimental Confirmation of Concepts Presented in Part I"; Beck et al., pp. 1–20.

"Peripheral Equipment for Diesel Fuel–Injection Systems"; Dr. –Ing. K.–O Riesenberg et al., pp. 192–196.

*Primary Examiner*—Kevin Weldon

*Attorney, Agent, or Firm*—Nilles & Nilles, S.C.

[57] ABSTRACT

A pintle nozzle, preferably an unthrottled pintle nozzle, is provided in which a negative interference angle is formed between the conical tip of the nozzle needle and the mating conical valve seat so that the needle seat is located at the bottom of the valve seat rather than at the top. The resulting nozzle lacks any velocity drop downstream of the needle seat, even at very low needle lifts, so that virtually all of the energy used to pressurize the fuel is converted to kinetic energy. Spray dispersion and penetration at low needle lifts therefore are significantly enhanced. Fuel flow through the converging-diameter discharge passage located between the conical needle tip and conical needle seat also self-centers the nozzle needle at low lifts, thereby helping to assure a symmetric spray and to further enhance spray characteristics. These and other advantages render the nozzle particularly useful for applications which require very small injection quantities such as the injection of fuel into small two-stroke gasoline engines or into pilot-ignited gas-fueled engines.

15 Claims, 4 Drawing Sheets

BOTTOM SEATED PINTLE NOZZLE

BACKGROUND OF THE INVENTION

1. Field of the Invention

The invention relates to nozzles and, more particularly, relates to a pintle nozzle in which a needle valve tip of the nozzle seats against the lower end portion of the associated valve seat to form a bottom seated pintle nozzle. The invention relates additionally to an improved method of ejecting liquid such as fuel from a nozzle.

2. Discussion of the Related Art

Nozzles are used for injecting liquids in a variety of applications by converting pressure energy into flow velocity to generate an injection spray. Applications are myriad. The invention is particularly but not exclusively applicable to a fuel injector nozzle adapted to selectively inject fuel into a combustion chamber of an internal combustion engine.

Nozzles used in fuel injection and related applications typically include a springloaded needle valve located at the tip of the nozzle which serves to suppress injection of fuel until the pressure of the fuel delivered to the nozzle's pressure chamber has reached a minimum level typically determined by the force of a return spring, hydraulic pressure or other force. The typical needle valve has a precision-ground tip having a conical shape that extends at a selected included angle. The upper portion of the sealing surface of the needle valve tip typically is selected to be either a cylindrical surface or the frustrum of a cone with a larger conical angle than that of the valve seat. The needle tip selectively seats on the valve seat to prevent injection and lifts from the seat to permit injection.

The nozzle in widest use in the industry today is generally known as the "hole type" injection nozzle. The hole type injection nozzle incorporates the use of spray holes downstream of the valve seat to control the size and direction of the spray. Hole type nozzles include sac-type nozzles and valve covers orifice or VCO nozzles. The spray holes of a sac-type nozzle are located in a passage, known as sac, located beneath the valve seat. The spray holes of a VCO nozzle are located directly in the valve seat and exhibit lower exhaust emissions than a sac-type nozzle because there is a smaller volume downstream of the valve seat in which residual fuel remains after valve closure. VCO nozzles are disclosed in SAE Paper No. 880299 and U.S. Pat. No. 5,467,754 to Beck (the Beck '754 patent).

Two portions of the flow passage of a hole type nozzle are restricted and cause a drop in pressure at low needle lift levels. These portions are at the needle seat and at the holes downstream of the needle seat. The pressure drop at the needle seat results in a decrease in the effective spray velocity at the holes which in turn results in a deterioration in the effectiveness of the spray because of a reduced applied pressure at the holes. The subsequent pressure drop at the holes is useful for spray generation depending upon how much of the pressure energy is converted to velocity of the spray emanating from the nozzle outlet.

A throttled pintle nozzle is one in which a cylindrical or other body is inserted into the center of an orifice beneath the conical needle tip to create an annular spray hole located beneath the valve seat in a manner similar to a hole type nozzle. The throttled pintle creates a pressure drop at the seat followed by the spray generating pressure drop in the annular space surrounding the pintle. At low values of needle lift, the pressure drop at the seat causes a deterioration in the maximum spray velocity. However, in the case of throttled pintle nozzles, the flow area at the seat increases very rapidly with increased needle lift and soon becomes much larger than the flow area of the annular space surrounding the pintle such that pressure drop at the seat becomes negligible. The pintle remains inside the downstream passage (at least at low needle lifts) and serves to guide the spray from the nozzle in a distribution determined by the shape of the pintle.

Deterioration in the quality and effectiveness of the spray from a nozzle can be mitigated by using an unthrottled pintle nozzle in which the spray velocity is generated at the seat or directly at the discharge orifice of the nozzle. The pintle is enlarged proximate its lower end to form a deflector that produces a conical spray with spray angles from zero to 120° or more. A "zero-angle pintle", lacks an enlarged deflector such that the resulting cylindrical pintle forms a cylindrical spray pattern having a diameter essentially the same as the diameter of the pintle.

In the case of unthrottled pintle nozzles, pressure energy is converted to velocity directly at the seat. The nozzle seat therefore is also effectively the nozzle outlet and results in maximum conversion of pressure to velocity with minimal loss of flow energy. In the case of the so-called "unthrottled" pintle nozzle, the annular space formed between the pintle and the peripheral wall of the surrounding cylindrical passage has an area that is substantially larger than the area of the seat orifice. In the more-common "throttled" pintle nozzle, on the other hand, the annular space between the pintle and the peripheral surface of the cylindrical passage is smaller than the area of the seat orifice and hence acts as the nozzle spray orifice by converting pressure to velocity in annular space. A throttled pintle nozzle is disclosed, for example, on pages 192–194 of *Diesel Fuel Injection*, by Robert Bosch GmbH. Unthrottled pintle nozzles are described, for example, in SAE Paper 880299 and in U.S. Pat. No. 3,830,433 to Miyake et al.

In order to improve sealing characteristics and to retain a fixed opening pressure as the sealing surface of the valve seat "wears in", the angle for the conical-shaped seating surface of a traditional nozzle needle valve is selected to be slightly smaller than that of the needle tip, giving an interference angle of the order of one degree and producing what will hereafter be described as a "top seated" needle in which the needle tip seats against the upper end of the valve seat.

Examination of the discharge passage of a top seated pintle nozzle at very low values of needle lift reveals that the cross sectional area of the discharge passage is larger at the outlet than at the inlet, causing a decrease in the flow velocity of the liquid fuel as it flows through the diffusing passage. This decrease in flow velocity results in a velocity drop across the valve seat and results in deterioration of the energy of the spray.

In addition, traditional top seated needle valves tend to lift eccentrically during the early stages of needle lift. The typical nozzle needle is guided for concentric movement within the nozzle by a cylindrical valve guide or bushing that surrounds a needle stem located above the needle tip. Some axial clearance must be provided between the needle stem and the valve guide to permit needle seating. At low values of needle lift, the location of the needle valve relative to an axial centerline of the nozzle is determined by pressure forces until the needle lift has increased sufficiently to take up the clearance between the valve guide and the needle stem and to permit the cylindrical upper guide surface of the needle valve to perform the guiding function. The Bernoulli principle mandates that pressure and velocity are inversely related. In a top seated pintle nozzle, fluid flows relatively slowly through the narrow upper end of the discharge passage. Relatively high pressures therefore are found at the upper end portion of the discharge passage. If for any reason the needle tip moves off the axis of the nozzle, the high pressure imposed by the flow of liquid through the narrow gap formed between the top seated needle valve and the seat tends to hold the needle tip off-center. A non-symmetrical spray pattern results.

OBJECTS AND SUMMARY OF THE INVENTION

It is therefore a primary object of the invention to provide a pintle nozzle that exhibits improved injection characteristics at low needle lifts.

Another object of the invention is to provide a pintle nozzle having a nozzle needle which is self-centering at low needle lifts.

In accordance with a first aspect of the invention, these objects are achieved in a remarkably simple and effective manner by providing a pintle nozzle in which the nozzle needle is bottom seated, i.e., seats against the bottom of the associated valve seat as opposed to the top. Bottom seating is achieved by providing a negative interference angle between the needle tip and the valve seat. Preferably, at least a portion of the valve seat and a portion of the needle tip are both frusto-conical in shape, and an interference angle, formed between the valve seat and the needle tip, is negative such that a discharge passage is formed above the needle seat that has a flow cross sectional area that increases continuously in diameter from the needle seat to an upper end of the valve seat.

Still another object of the invention is to provide an improved method of injecting liquid from a pintle nozzle.

In accordance with another aspect of the invention, this object is achieved by providing a nozzle having 1) a nozzle needle including a lower needle tip and 2) a nozzle body having a valve seat located therein which receives the needle tip. Subsequent steps include seating the needle tip on the valve seat at a needle seat positioned adjacent a seat orifice of the nozzle so as to prevent liquid ejection from the nozzle, and then lifting the needle tip from the valve seat to eject liquid from the nozzle by permitting fuel flow from a discharge passage formed between the needle tip and the bottom of the valve seat, then past the needle seat, and then out of the seat orifice.

Preferably, during the injection step, the discharge passage decreases continuously in cross sectional area from an upper end of the valve seat towards the needle seat at a designated needle lift. The fluid 1) flows through the discharge passage at an increasing velocity, 2) flows at a maximum velocity at the exit end of the needle seat, and 3) is ejected from the seat orifice at substantially the maximum velocity.

A pressure differential is formed from an upstream end of the annular discharge passage to a downstream end of the annular discharge passage that tends to center the needle tip axially with respect to the valve seat. With a bottom seated pintle, any eccentricity of the needle centerline causes a distribution of pressure in the aforementioned annular discharge passage in which the pressure on the near side will be increased by virtue of the velocity being lower on the near side and vice versa such that the needle becomes self-centering. For the top seated pintle, on the other the other hand, circumferential distribution of velocity and pressure in the annular space becomes unstable resulting in a tendency to maintain an eccentric location of the needle.

Other objects, features, and advantages of the invention will become apparent from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment to the invention is illustrated in the accompanying drawing in which like reference numerals represent like parts throughout, and in which.

DETAILED DESCRIPTION OF THE PREFERRED EMBODIMENT

1. Resume

Pursuant to the invention, a pintle nozzle, preferably an unthrottled pintle nozzle, is provided in which a negative interference angle is formed between the conical tip of the nozzle needle and the mating conical valve seat so that the needle seat is located at the bottom of the valve seat rather than at the top. The resulting nozzle encounters minimum pressure losses through the needle seat, especially at very low needle lifts, so that virtually all of the energy used to pressurize the fuel is converted to kinetic energy. For example, the ratio of spray energy compared to maximum theoretical spray energy is proportional to the square of the exit velocity. Spray dispersion and penetration at low needle lifts therefore are significantly enhanced. Fuel flow through the convergingdiameter discharge passage located between the conical needle tip and conical needle seat also self-centers the nozzle needle at low lifts, thereby helping to assure a symmetric spray and to further enhance spray characteristics. These and other advantages render the nozzle particularly useful for applications which require very small injection quantities such as the injection of fuel into small two-stroke gasoline engines or into pilot-ignited gas-fueled engines.

2. Construction of Bottom Seated Pintle Nozzle

Figure 1:
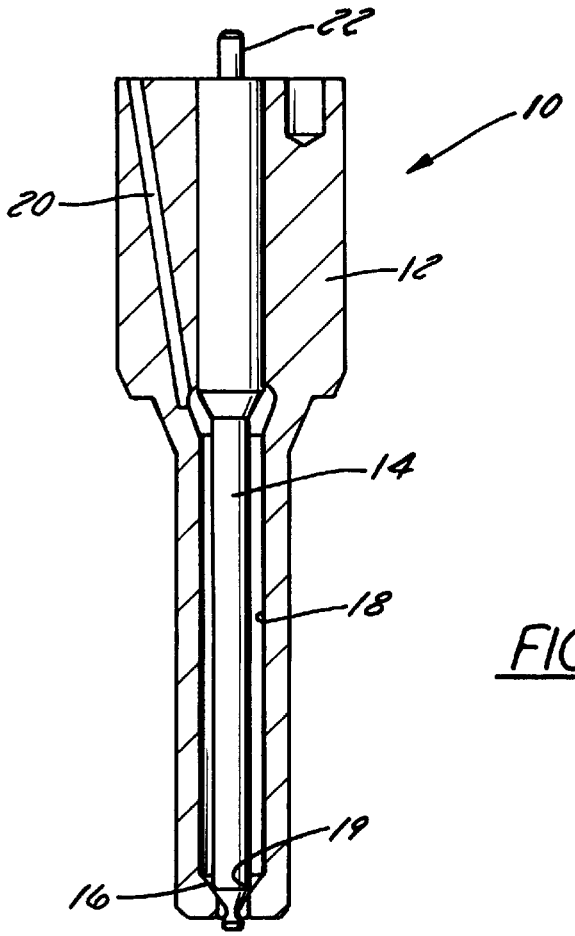
FIG. 1 is a sectional elevation view of a portion of a bottom seated pintle nozzle constructed in accordance with a preferred embodiment of the present invention.
Figure 2:
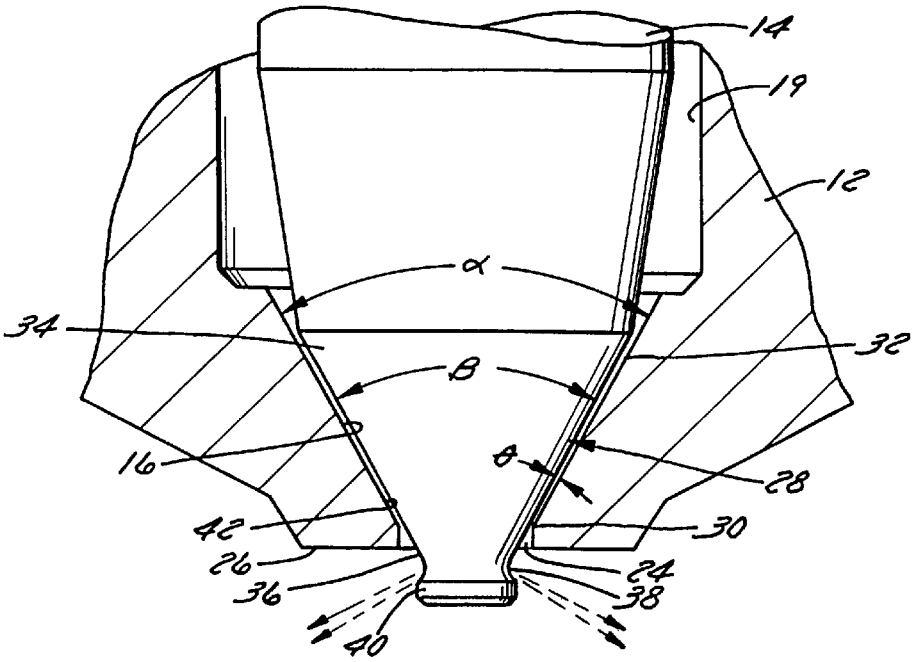
FIGS. 2 and 3 are enlarged fragmentary sectional views of the nozzle of FIG. 1, illustrating the needle valve assembly in its open and closed position, respectively.
Figure 3:
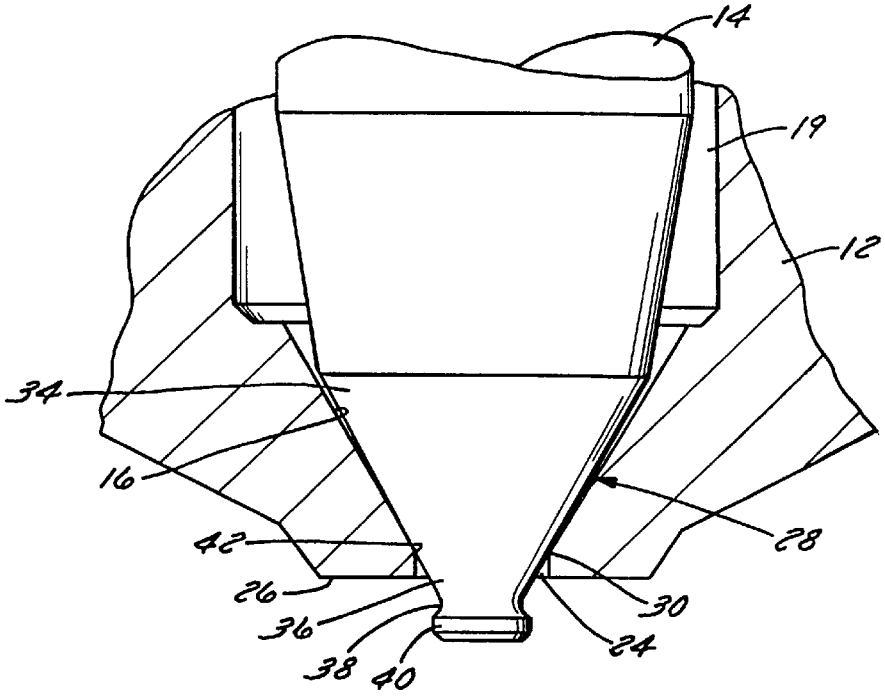

Referring now to the drawings and initially to FIGS. 1–3, a pintle nozzle 10 is illustrated that is constructed in accordance with a preferred embodiment of the invention. The nozzle 10 could be used to inject virtually any liquid, but is particularly well-suited for injecting liquid fuel such as gasoline or diesel fuel into a combustion chamber of an internal combustion engine. Hence, the nozzle 10 will generally be discussed for use as a fuel injector with its working liquid being fuel. It should be understood, however, that the invention encompasses pintle nozzles usable to inject virtually any liquid.

The pintle nozzle 10 includes a nozzle body 12 in which is housed a needle valve assembly that includes a nozzle needle 14 and a valve seat 16. The nozzle needle 14 is slidably received in a bore 18 extending axially upwardly into the nozzle body 12 from the valve seat 16. A pressure chamber 19 is formed around the lower portion of the nozzle needle 14 and is coupled to a source of pressurized fuel (not shown) by a fuel inlet passage 20. The upper end of the nozzle needle 14 is connected to a needle stem 22 that in turn is guided by a bushing or other needle guide (not shown) for concentric movement with the bore 18. The nozzle needle 14 is biased downwardly towards the valve seat 16 by a return spring (also not shown) acting on an upper surface of the needle guide. A relatively short cylindrical passage 24 is formed in the nozzle body 12 beneath the valve seat 16 and opens into a bottom surface 26 of the nozzle body 12 for purposes detailed below.

The active elements of the valve assembly include the valve seat 16 and a lower tip 28 of the needle 14 best seen in FIGS. 2 and 3. The valve seat 16, which typically is machined directly into the nozzle body 12 and forms the bottom end portion of the bore 18, terminates in a seat orifice 30. The needle tip 28 is configured to selectively 1) seat on the valve seat 16 to prevent injection and 2) lift from the valve seat 16 to permit injection. A discharge passage 32 (FIG. 2) is formed between the valve seat 16 and the needle tip 28 when the needle tip 28 is in its lifted position to permit fuel to flow from the pressure chamber 19, through said discharge passage 32, and out of the injection valve assembly through the seat orifice 30. The valve seat 16 and at least a portion of the needle tip 28 that seals against the valve seat 16 are generally conical or frusto-conical in shape (the term conical as used herein encompassing structures taking the shape of a right angle cone as well as other structures that decrease in cross sectional area from upper to lower ends thereof).

The needle tip 28 includes a frusto-conical portion 34 for engagement with the valve seat 16 and a pintle 36 that extends downwardly from the frusto-conical portion 34. The frusto-conical portion 34 is longer than the valve seat 16 but could be considerably shorter or even could take some other shape so long as it is configured relative to the valve seat 16 to be "bottom seating" as that term is defined below. The pintle 36 extends downwardly beyond the valve seat 16 (at least when the needle tip 28 is seated on the valve seat 16), through the cylindrical passage 24, and downwardly beyond the bottom end 26 of the nozzle body 12. The illustrated pintle 36 takes the form of an extended portion of the frusto conical portion cone 34 which then merges with an enlarged deflector 40 via a neck 38. The spray angle of injected fuel will depend upon the configuration of the pintle 36 including the shape and size of the deflector 40 relative to the shape and size of the neck 38. The deflector 40 of the illustrated embodiment is relatively large when compared to the neck 38 to produce a large spray angle. However, the invention is equally applicable to a so-called zero-angle pintle which lacks a deflector and which instead has a cylindrical pintle. The spray angle produced by a zero-angle pintle is a cylinder having a diameter commensurate with the diameter of the pintle. The invention is also applicable to a so-called zero-pintle pintle lacking any structure that extends beneath the conical valve seat 16 when the needle tip 28 is in its closed or seated position. It has been found that the zero-pintle pintle produces a very narrow, highly penetrating jet that resembles a laser beam.

In the preferred and illustrated embodiment, the pintle nozzle 10 is a so-called unthrottled pintle nozzle 10 in which the area of the gap formed between the pintle 36 and the peripheral surface of the cylindrical passage 24 is always larger than the effective area of the seat orifice 30 so that minimum flow restriction takes place downstream of the valve seat 16. This configuration assures that fuel is discharged from the nozzle 10 at the maximum velocity—an important consideration at low needle lifts and small fuel injection quantities. However, the invention is also applicable to so-called throttled pintle nozzles or throttling pintle nozzles in which the area of the gap between the pintle and the peripheral surface of the cylindrical passage is smaller than the area of the seat orifice to create a second orifice downstream of the seat orifice.

The included angle $\alpha$ of the valve seat cone and the included angle $\beta$ of the needle tip cone usually are different so that an included interference angle $\theta$ is formed therebetween in order to assure seating at a distinct needle seat that extends only part way along the length of the valve seat 16 and that theoretically comprises line contact. Conventional wisdom is to make this interference angle positive so that the needle seat is located at the upper end of the valve seat. However, pursuant to the invention, the interference angle $\theta$ is set to be negative so that the conical portion 34 of the needle tip 28 seats against a needle seat 42 located at the bottom end of the valve seat 16 at a location at or closely adjacent to the seat orifice 30, hence producing a bottom seated pintle nozzle. As a result, the cross-sectional area of the passage 32 increases continuously from the seat orifice 30 to its upper end. This interference angle $\theta$ must be set sufficiently large so that seating at the desired location at the bottom of the valve seat 16 is achieved, but must be set sufficiently small so to distribute the impact forces occurring upon needle closure sufficiently to avoid undue impact stresses on the needle tip 28 and valve seat 16. Preferably, the interference angle $\theta$ should range between 0.5° and 2°, and it most preferably should be set at about 1°.

3. Operation of Injector and Effects of Bottom Seated Pintle Nozzle

In operation, the nozzle needle 14 of the nozzle 10 is normally forced into its closed or seated position as seen in FIG. 3 by the return spring (not shown). When it is desired to initiate an injection event, fuel is admitted into the pressure chamber 19 from the fuel inlet passage 20. When the lifting forces imposed on the needle 14 by the pressurized fuel in the pressure chamber 19 overcome the closing forces imposed by the spring, the nozzle needle 14 lifts to permit fuel to flow through the discharge passage 32, past the needle seat 42, out of the seat orifice 30, and then out of the nozzle 10. The nozzle needle 14 closes to terminate the injection event when the fuel pressure in the pressure chamber 19 decays sufficiently to cause the resulting lifting forces drop to beneath the closing force imposed on the needle 14 by the return spring.

Figure 6:
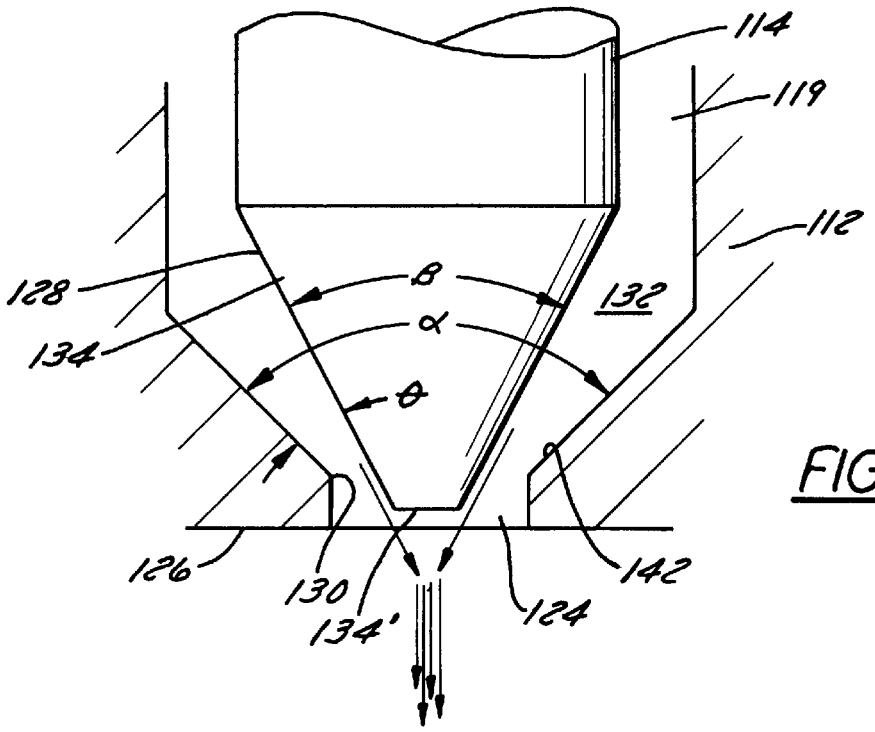
FIG. 6 is a fragmentary sectional view of a zero-pintle pintle nozzle constructed in accordance with another embodiment of the invention.

The angle of the ejected spray will depend upon the shape of the deflector 40. In the illustrated embodiment, the deflector 40 produces a spray angle of approximately 120°–125°. However, this angle could be reduced to 0° if the pintle 36 were to be replaced with a zero angle pintle or a zero-pintle pintle. As seen in FIG. 6, spray from the zero-pintle pintle nozzle 110, which lacks a pintle beneath the end 134' of the conical or frusto-conical portion 134, takes the form of a pencil-thin jet. All other components of the zero-pintle pintle nozzle 110 of FIG. 6 are at least essentially the same as the pintle nozzle 10 of FIG. 1–3 and, accordingly are designated by the same reference numerals, incremented by 100.

Needle closure imparts significant spring and impact forces to the needle seat 16. Because the needle seat 42 is located near the bottom end 26 of the nozzle body 12, these forces could result in damage to the nozzle body 12 but for the presence of the cylindrical passage 24 which reduces the local stress concentration. The walls of the passage 24 are positioned between the needle seat 42 and the bottom 26 of the nozzle body 12 and are sufficiently thick to resist the forces imposed on the nozzle body 12 by the bottom seated needle tip 28. Hence, even if the cylindrical passage 24 were not provided for functional purposes, it would still be desirable to incorporate it into the design to strengthen the bottom end portion of the nozzle body 12.

Several distinct operational advantages arise through operation of the bottom seated pintle nozzle 10.

First, the bottom seated pintle nozzle 10 exhibits marked improvements in injection characteristics at low needle lifts. The reasons for this improvement can be better understood from an understanding of flow characteristics of liquid through a nozzle. The effectiveness of fuel spray from the injection nozzle is usually dependent, at least partly, on the efficiency of the conversion of pressure energy to spray velocity. This conversion can be quantified by calculating the ratio of actual spray velocity at the seat orifice to the ideal maximum velocity that would occur absent any pressure losses. The actual spray velocity at any point along the discharge passage can be defined by dividing the volumetric flow rate of the flowing fuel being injected by the flow area of that portion of the discharge passage.

Figure 4:
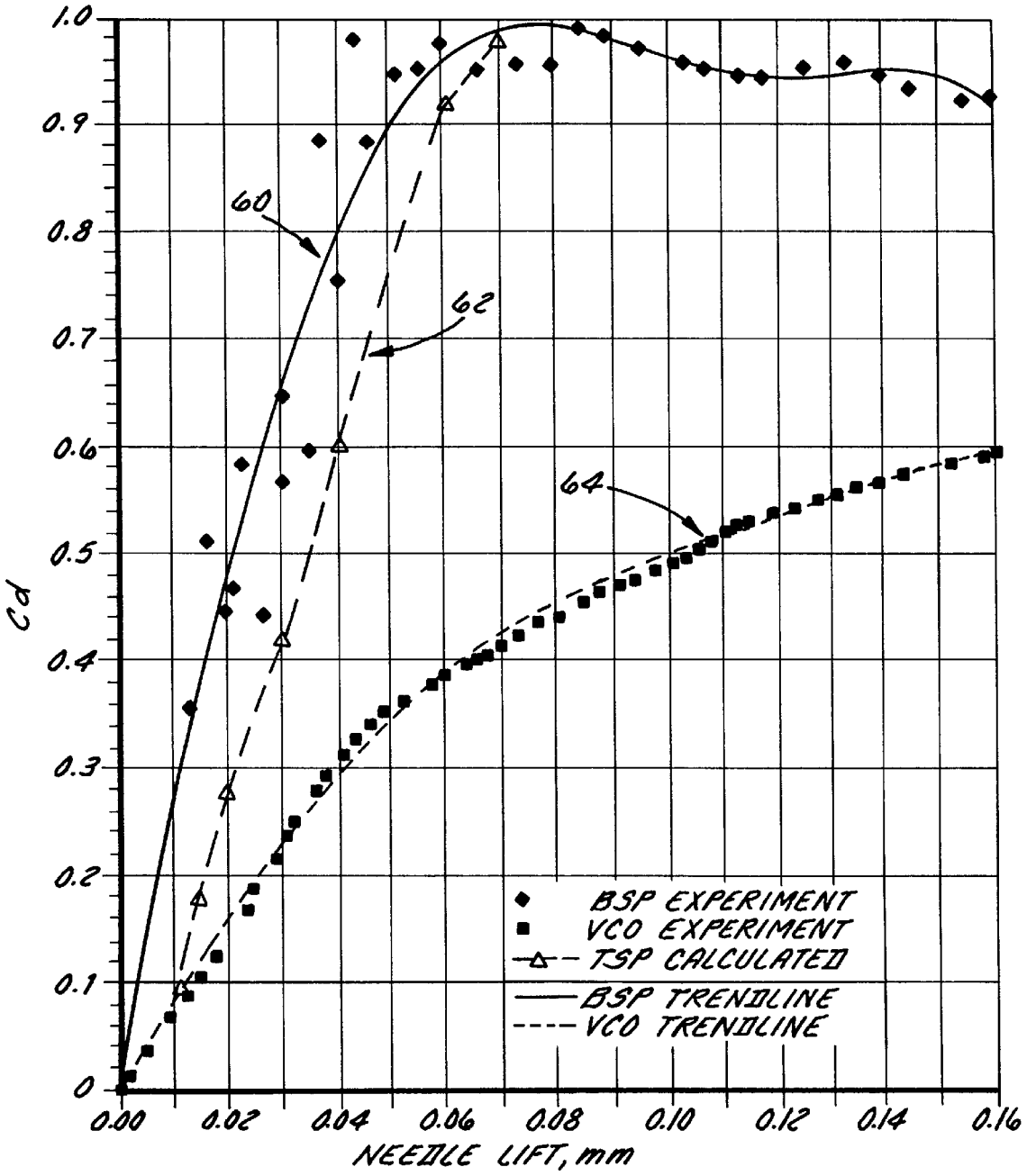
FIG. 4 is a graph of flow coefficient verses needle lift for an unthrottled pintle nozzle and a hole type nozzle.

The spray efficiency of a nozzle can then be quantified by calculating a flow or discharge coefficient of that nozzle. The discharge coefficient is defined by dividing the calculated actual exit velocity from the discharge orifice of a nozzle by the theoretical maximum exit velocity generated by the applied pressure. This example is for an accumulator type of injector as described in Re. 33,270 and, for simplicity only, the opening portion of the injection event is shown. The fluid coefficient is defined as the ratio of spray velocity at the nozzle exit area divided by the theoretical maximum velocity that can be generated by the applied injection pressure; and Flow coefficients versus needle lift for a bottom seated pintle nozzle (BSP), a comparable top seated pintle (TSP), and a comparable VCO nozzle are plotted in FIG. 4 by the curves 60, 62, and 64, respectively. These curves illustrate that, at any designated low needle lift value, the discharge coefficient of the BSP is significantly higher than the discharge coefficient of the TSP and dramatically higher than the discharge coefficient of the VCO. For instance, at a needle lift of 0.03 mm, the discharge coefficients of the BSP, TSP, and VCO are approximately 0.65, 0.40, and 0.25, respectively. At needle lifts above 0.035 (the point at which the flow passage of both BSP and TSP become converging), the flow coefficients are essentially the same for a TSP and a BSP but are still much lower for a VCO due to the lowered pressure at the inlet to the spray hole. For instance, at a needle lift of 0.6 mm, the discharge coefficient of the BSP and the TSP are both above 0.95, whereas the discharge coefficient of the comparable VCO type hole nozzle is still only about 0.4.

The flow area at the top of the discharge passage of a conventional TSP is less than the area at the seat orifice for needle lift values of 0.0 to 0.035 mm. On the other hand, the flow area of the discharge passage of a BSP is less at the seat orifice 30 than at the top of the discharge passage 32 for all values of at needle lift. The laws of continuity or flow consequently dictate that the flow velocity at the seat orifice 30 of the BSP will be less than that at the upper end of the discharge passage by an amount proportional to the difference in flow area at the seat orifice 30 as compared to that at the upper end of the discharge passage 32. For example, at a needle lift of 0.005 mm, the flow area at the top of the discharge passage of a TSP nozzle is 0.0125 $mm^2$, and the area at the bottom of the passage is 0.025 $mm^2$, or a ratio of 0.5:1.0. This difference may seem inconsequential at first glance. However, considering that, at the same needle lift and flow rate, the flow area of the BSP 10 is 0.045 $mm^2$ at the top of the discharge passage 32 and 0.0125 mm at the bottom, i.e., at the seat orifice 30. The spray velocity at the outlet or seat orifice of the bottom seated pintle nozzle therefore will be twice that of the top seated pintle nozzle at the same needle lift due to the converging flow area of the discharge passage 32 of the bottom seated pintle nozzle 10. Since the kinetic energy of the spray is proportional to the square of the velocity, the spray energy of the bottom seated pintle nozzle 10 will be four times that of a comparable top seated pintle at the same needle lift and volumetric flow rate.

Figure 5:
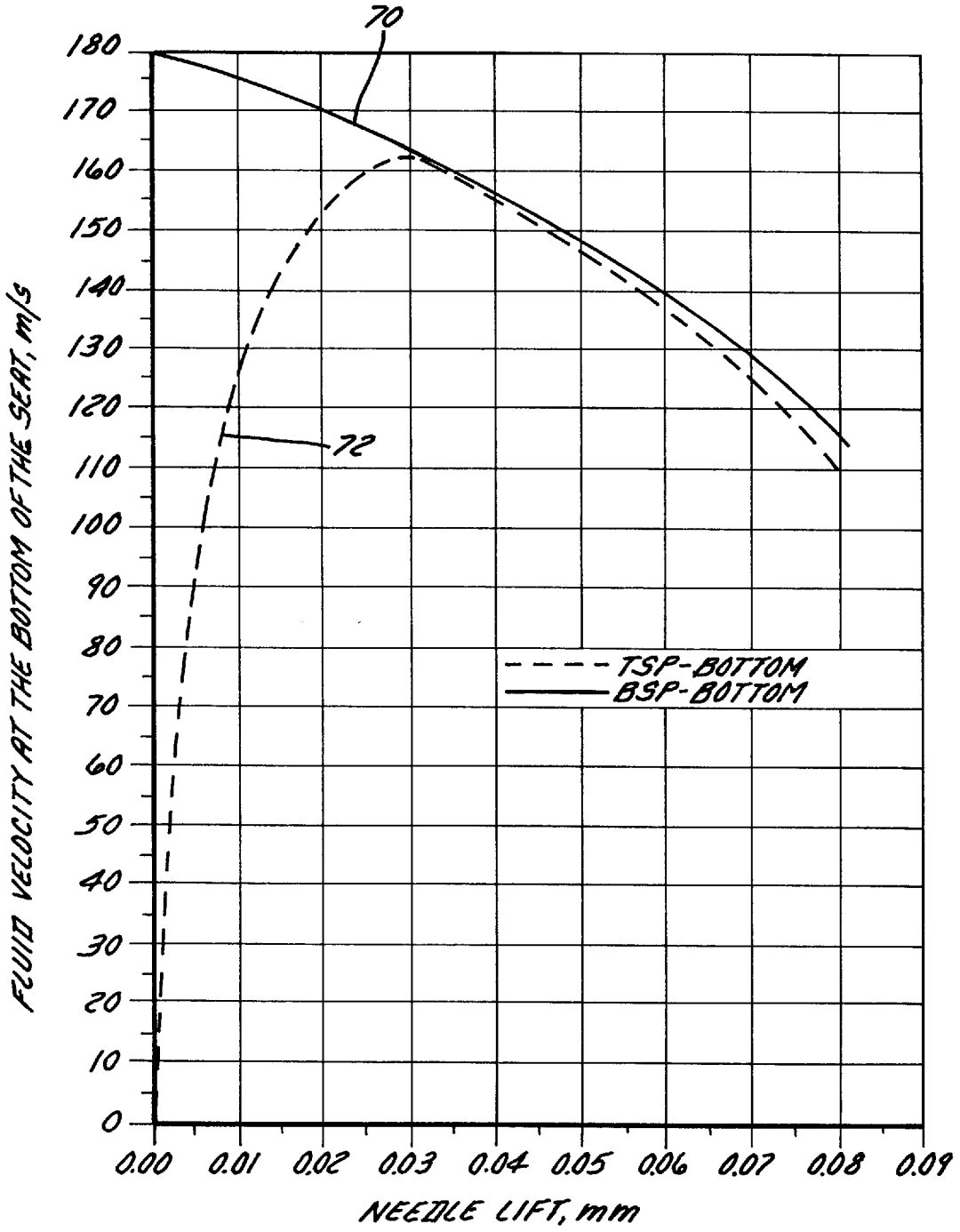
FIG. 5 is a graph of velocity versus needle lift at the bottom of the discharge passage for a bottom seated pintle nozzle and a top seated pintle nozzle.

The import of this effect can be appreciated by the curves 70 and 72 in FIG. 5 which plot fluid velocity at the bottom of the discharge passage for both the BSP and the TSP. Particularly relevant are the curves which illustrate that, at needle lifts beneath about 0.03 mm, the velocity at the bottom of the discharge passage of the BSP is substantially higher than at the bottom of the discharge passage of the TSP. At a lift of 0.01 mm, the spray velocity of the BSP is 175 n/s vs. 121 for the TSP, or an energy ratio of 2:1.

The practical advantages of improved fuel flow at low needle lifts range from significant to dramatic. The advantages may be significant even in applications in which the low needle lift portion of an injection cycle constitutes but a small portion of the injection event (i.e., when the needle lifts completely to a height of 0.3 mm to 0.5 mm and remains at that height for a substantial time prior to closing) because the fuel injected under these low lift conditions may still represent 5%–10% of the total fuel charge. Injecting even that relatively small percentage of fuel in a poor spray pattern significantly increases hydrocarbon emissions from unburnt fuels and may cause engines used in some applications to fail to meet emission standards. The problem becomes much more pronounced in applications in which the injector nozzle is used to inject greater percentages of each fuel charge at relatively low needle lifts. These applications include those in which a relatively small quantity of fuel is injected during each injection event, such as the supply of fuel to a small gasoline-powered two-cycle engine or the supply of a pilot fuel to a pilot-ignited gas-fueled engine in which the maximum needle lift can be as low as 0.01 mm to 0.02 mm.

In addition, unlike the traditional top seated pintle nozzle, the inventive bottom seated pintle nozzle 10 tends to be self centering at low needle lifts. As discussed above, the guide bushing or other guide structure of a typical fuel injector cannot help center the needle until the needle overcomes a certain clearance upon initial needle lift. It is common for the needle tip to move off the axial centerline of the bore upon initial needle lift. Fuel flow past an off-center needle tip and through the widening discharge passage of a conventional top seated pintle nozzle is unstable and tends to force the needle further away from center for reasons described in the "Background" section above. A non-symmetrical spray pattern results.

In sharp contrast, when fuel flows through the converging discharge passage 32 formed by the negative interference angle θ of a bottom seated pintle nozzle 10, the largest gap through which the fuel flows is located at the top of the discharge passage 32 rather than at the bottom. The radial force imposed on the needle 14 at the top of the discharge passage 32 therefore is stabilizing as compared to that imposed by a top seated pintle nozzle. The forces imposed by the flow of fuel through the discharge passage 32 of the bottom seated pintle nozzle 10 tend to recenter an off-center needle—the top seating pintle.

In addition to enhancing injection characteristics at the beginning of an injection event, the bottom seated pintle nozzle 10 also reduces emissions that otherwise would occur after an injection event. In a hole type nozzle, and even in a conventional top seated pintle nozzle, substantial passage volumes exist beneath the needle seat in which fuel remains after needle closure and after it is desired to end an injection event. This residual fuel dribbles out of the nozzle and is emitted as unburnt hydrocarbons. In sharp contrast, because the needle seat 42 of the bottom seated pintle nozzle 10 is located at the bottom end of the valve seat 16, there is virtually no passage volume beneath the needle seat 42 in which residual fuel remains after valve closure.

The minimized seat area resulting from needle seating at the lower end of the conical valve seat 16 also results in a high turn down ratio (the ratio of maximum fuel delivery to minimum fuel delivery) because the needle valve opening and closing pressures are nearly the same.

The enhanced injection characteristics resulting from use of the bottom seated pintle nozzle 10 enables the improved operation of a pintle nozzle in a variety of applications including:

1. The generation of a highly penetrating jet with zero-degree hollow cone spray;
2. The generation of a non-coalescing expanding cloud injection spray (ECIS spray) when used in the technique described in U.S. Pat. No. 5,392,742 to Beck (the subject matter of which is hereby incorporated by reference in its entirety);
3. The maximization of spray energy when used as an impingement jet such as the jet described in SAE Paper No. 940667 to Kato et al;
4. The minimization of the seat area exposed to cylinder pressure and a resulting minimization of a tendency for the needle to re-open and emit burnt gases into the nozzle;
5. The facilitation of adjustment of spray penetration by selection of injection pressure, needle lift, cone angle, and swirl; and
6. The enhancement of the capability of injecting fuel at a very high rate, particularly when used in conjunction with an accumulator type injector of the type described, for example, in the above described Beck '745 patent.

Many changes and modifications could be made without departing from the spirit of the invention. Some of these changes are described above and include the use of a bottom seated needle in a throttled pintle nozzle rather than in an unthrottled pintle nozzle as well as the replacement of the illustrated pintle with a zero angle pintle or even a zero-pintle pintle. The scope of other changes encompassed by the present invention will become apparent from the appended claims.

I claim:

1. A bottom seated unthrottled pintle nozzle comprising:

(A) a nozzle body having a frusto-conically-shaped valve seat formed therein that increases continuously in diameter from a lower seat orifice thereof to an upper end thereof at an included angle of $\alpha$; and (B) a nozzle needle movable substantially axially with respect to said valve seat, said nozzle needle including a lower needle tip movable 1) from a lowered, seated position in which said needle tip seats against said valve seat at a needle seat so as to prevent fluid flow through said nozzle 2) to a lifted position in which said needle tip is spaced from said valve seat to permit fluid to flow through a discharge passage formed between said needle tip and said valve seat, past said needle seat, and out of said seat orifice, wherein at least a portion of said needle tip has a frusto-conically-shaped peripheral surface that increases continuously in diameter from a lower end thereof to an upper end thereof at an included angle $\beta$, said angle being between 0.5° and 2.0° less than said angle $\alpha$ so that said needle seat is located at a bottom end of said valve seat, wherein a seat orifice flow area 1) is formed between said nozzle needle and said needle seat, 2) is normal to a direction of fluid flow past said needle seat, and 3) increases rapidly with needle lift from a value of zero when said nozzle needle assumes its seated position to a maximum value when said nozzle needle assumes a full-lift position, and wherein said seat orifice flow area is the smallest flow area through said pintle nozzle at all phases of needle lift so that fluid flow downstream of said seat orifice flow area is always unthrottled.

2. A bottom seated unthrottled pintle nozzle as defined in claim 1, wherein said angle $\beta$ is about 1.0° less than said angle $\alpha$.

3. A bottom seated unthrottled pintle nozzle as defined in claim 2, wherein said angle $\beta$ is about 57° and said angle $\alpha$ is about 58°.

4. A bottom seated unthrottled pintle nozzle as defined in claim 1, further comprising a cylindrical passage formed in said nozzle body beneath said valve seat, said seat orifice flow area being smaller than a cross-sectional area of said cylindrical passage at all phases of needle lift.

5. A bottom seated unthrottled pintle nozzle as defined in claim 4, wherein said nozzle needle further comprises a cylindrical pintle extending axially downwardly from said needle tip and having a diameter that is smaller than a diameter of said cylindrical passage.

6. A bottom seated unthrottled pintle nozzle as defined in claim 4, wherein said nozzle needle is a zero-pintle nozzle needle lacking a structure extending axially downwardly from said needle tip.

7. A bottom seated pintle nozzle comprising:

(A) a nozzle body in which is located a valve seat; and (B) a nozzle needle including a needle tip which is selectively 1) seatable on said valve seat at a needle seat and 2) liftable with respect to said valve seat to permit fluid flow past said needle seat and out of said nozzle body, wherein at least a portion of said needle tip has a frusto-conically-shaped peripheral surface that increases continuously in diameter from a lower end thereof to an upper end thereof at an included angle $\beta$, said angle being between 0.5° and 2.0° less than an included angle $\alpha$ of said valve seat so that said needle seat is located at a bottom end of said valve seat, wherein a seat orifice flow area 1) is formed between said nozzle needle and said needle seat, 2) is normal to a direction of fluid flow past said needle seat, and 3) increases rapidly with needle lift from a value of zero when said nozzle needle assumes its seated position to a maximum value when said nozzle needle assumes a full-lift position, and wherein said seat orifice flow area is the smallest flow area through said pintle nozzle at all phases of needle lift so that fluid flow downstream of said seat orifice flow area is always unthrottled.

8. A bottom seated pintle nozzle as defined in claim 7, wherein a nozzle flow discharge coefficient of said nozzle, defined as the actual velocity of liquid ejected from said nozzle under designated operating conditions divided by the theoretical maximum velocity under said designated operating conditions, is over 0.4 at a needle lift of 0.03 mm.

9. A bottom seated pintle nozzle as defined in claim 8, wherein said nozzle flow discharge coefficient is over 0.6 at said needle lift of 0.03 mm.

10. A bottom seated pintle nozzle as defined in claim 7, wherein said interference angle is about 1.0°.

11. A nozzle comprising:

(A) a valve seat; and (B) a nozzle needle having a needle tip which is selectively seatable on said valve seat, wherein a nozzle flow discharge coefficient of said nozzle, defined as the actual velocity of liquid ejection from said nozzle under designated operating conditions divided by the theoretical maximum velocity under said designated operating conditions, is over 0.5 at a needle lift of 0.03 mm, wherein at least a portion of said needle tip has a frusto-conically-shaped peripheral surface that increases continuously in diameter from a lower end thereof to an upper end thereof at an included angle β, said angle being between 0.5° and 2.0° less than an included angle α of said valve seat so that a needle seat of said valve seat is located at a bottom end of said valve seat, wherein a seat orifice flow area 1) is formed between said nozzle needle and said needle seat, 2) is normal to a direction of fluid flow past said needle seat, and 3) increases rapidly with needle lift from a value of zero when said nozzle needle assumes its seated position to a maximum value when said nozzle needle assumes a full-lift position, and wherein said seat orifice flow area is the smallest flow area through said pintle nozzle at all phases of needle lift so that fluid flow downstream of said seat orifice flow area is always unthrottled.

12. A nozzle as defined in claim 11, wherein said nozzle flow discharge coefficient of said nozzle is over 0.6 at said needle lift of 0.03 mm.

13. A method of injecting a liquid from a nozzle comprising:

(A) providing a nozzle having 1) a nozzle needle including a lower needle tip and 2) a nozzle body having a valve seat located therein which receives said needle tip;

(B) seating said needle tip on said valve seat at a needle seat positioned adjacent a seat orifice of said nozzle so as to prevent liquid ejection from said nozzle; and then (C) lifting said needle tip from said valve seat to eject liquid from said nozzle by permitting fuel flow from a discharge passage formed between said needle tip and said valve seat, then past said needle seat, and then out of said seat orifice, wherein at least a portion of said needle tip has a frusto-conically-shaped peripheral surface that increases continuously in diameter from a lower end thereof to an upper end thereof at an included angle β, said angle being between 0.5° and 2.0° less than an included angle α of said valve seat so that said needle seat is located at a bottom end of said valve seat, wherein a seat orifice flow area 1) is formed between said nozzle needle and said needle seat, 2) is normal to a direction of fluid flow past said needle seat, and 3) increases rapidly with needle lift from a value of zero when said nozzle needle assumes its seated position to a maximum value when said nozzle needle assumes a full-lift position, and wherein said seat orifice flow area is the smallest flow area through said pintle nozzle at all phases of needle lift so that fluid flow downstream of said seat orifice is unthrottled so that, during said step (C), said discharge passage decreases continuously in cross sectional area from an upper end of said valve seat towards said needle seat at a designated needle lift, and wherein said fluid 1) flows through said discharge passage at an increasing velocity, 2) flows at a maximum velocity at said needle seat, and 3) is elected from said seat orifice at substantially said maximum velocity.

14. A method as defined in claim 13, wherein, upon needle tip lift, a pressure differential is formed from an upstream end of said discharge passage to a downstream end of said discharge passage that tends to center said needle tip axially with respect to said valve seat.

15. A zero-pintle pintle nozzle comprising:

A) a nozzle body having a frusto-conically-shaped valve seat formed therein that increases continuously in diameter from a lower seat orifice thereof to an upper end thereof; and (B) a nozzle needle movable substantially axially with respect to said valve seat, said nozzle needle including a lower needle tip movable 1) from a lowered, seated position in which said needle tip seats against said valve seat at a needle seat so as to prevent fluid flow through said nozzle 2) to a lifted position in which said needle tip is spaced from said valve seat to permit fluid to flow through a discharge passage formed between said needle tip and said valve seat, past said needle seat, and out of said seat orifice, wherein at least a portion of said needle tip has a frusto-conically-shaped peripheral surface that increases continuously in diameter from a lower end thereof to an upper end thereof, said nozzle needle lacking any structure extending axially downwardly from said portion of said needle tip, wherein at least a portion of said needle tip has a frusto-conically-shaped peripheral surface that increases continuously in diameter from a lower end thereof to an upper end thereof at an included angle β, said angle being between 0.5° and 2.0° less than said angle α so that said needle seat is located at a bottom end of said valve seat, wherein a seat orifice flow area 1) is formed between said nozzle needle and said needle seat, 2) is normal to a direction of fluid flow past said needle seat, and 3) increases rapidly with needle lift from a value of zero when said nozzle needle assumes its seated position to a maximum value when said nozzle needle assumes a full-lift position, and wherein said seat orifice flow area is the smallest flow area through said pintle nozzle at all phases of needle lift so that fluid flow downstream of said seat orifice is always unthrottled.

* * * * *

UNITED STATES PATENT AND TRADEMARK OFFICE

CERTIFICATE OF CORRECTION

PATENT NO. : 5,853,124
DATED : December 29, 1998
INVENTOR(S) : Niels J. BECK et al.

It is certified that error appears in the above-identified patent and that said Letters Patent is hereby corrected as shown below:

Column 4, line 52, delete "convergingdiameter" and insert -- converging-diameter --.

Column 7, line 7, delete "needle" (first occurrence) and insert -- valve --.

Column 9, line 49, delete "'745" and insert -- '754 --.

Column 10, line 12, after "angle" insert -- $\beta$ --.

Column 10, line 55, after "angle" insert -- $\beta$ --.

Column 11, line 28, after "angle" insert -- $\beta$ --.

Column 12, line 11, delete "pintel".

Column 12, line 30, after "thereof" and before the semicolon, insert -- at an included angle of $\alpha$ --.

Column 12, line 50, after "angle" insert -- $\beta$ --.

Signed and Sealed this

Twentieth Day of April, 1999

*Attest:*

Q. TODD DICKINSON

*Attesting Officer*

*Acting Commissioner of Patents and Trademarks*